US006067837A

United States Patent [19]

Garlaschi

[11] Patent Number: 6,067,837

[45] Date of Patent: May 30, 2000

[54] DEVICE FOR THE EXTRACTION OF SMALL METAL ITEMS

[75] Inventor: Eufemia Garlaschi, Milan, Italy

[73] Assignee: Carlo Salvi & C. S.r.l., Milan, Italy

[21] Appl. No.: 09/182,045

[22] Filed: Oct. 29, 1998

[30] Foreign Application Priority Data

Apr. 17, 1998 [IT] Italy ..... MI98A0825

[51] Int. Cl.[7] ..... B21D 45/00

[52] U.S. Cl. ..... 72/345; 72/452.2; 470/152

[58] Field of Search ..... 72/344, 345, 452.2, 72/452.4, 452.6; 470/57, 58, 137–139, 141, 152

[56] References Cited

U.S. PATENT DOCUMENTS

| | | | |
|---|---|---|---|
| 2,547,304 | 4/1951 | Broscomb | 470/152 |
| 3,299,453 | 1/1967 | Van De Meerendonk | 470/137 |
| 3,820,376 | 6/1974 | Koch et al. | 470/152 |
| 4,250,730 | 2/1981 | Richner | 72/344 |
| 4,488,426 | 12/1984 | Wisebaker | 72/345 |
| 4,538,437 | 9/1985 | Wisebaker | 72/345 |

*Primary Examiner*—Ed Tolan
*Attorney, Agent, or Firm*—Bucknam and Archer

[57] ABSTRACT

A device for the extraction of small metal items, especially applicable to automatic forging machines for the production of screws, rivets and the like, provided with one or more forming punches (1), comprises means (25), (27), (28), (29), (30), (10) articulated with one another and/or the casing of the forging machine, activated by a drive shaft of the same through one or more cams (20), (33) or the like, and co-operating with the back end of one or more pegs (11), (2) coaxial with respect to the forged item placed in sad punch(es).

8 Claims, 2 Drawing Sheets

DEVICE FOR THE EXTRACTION OF SMALL METAL ITEMS

DESCRIPTION

Figure 1:
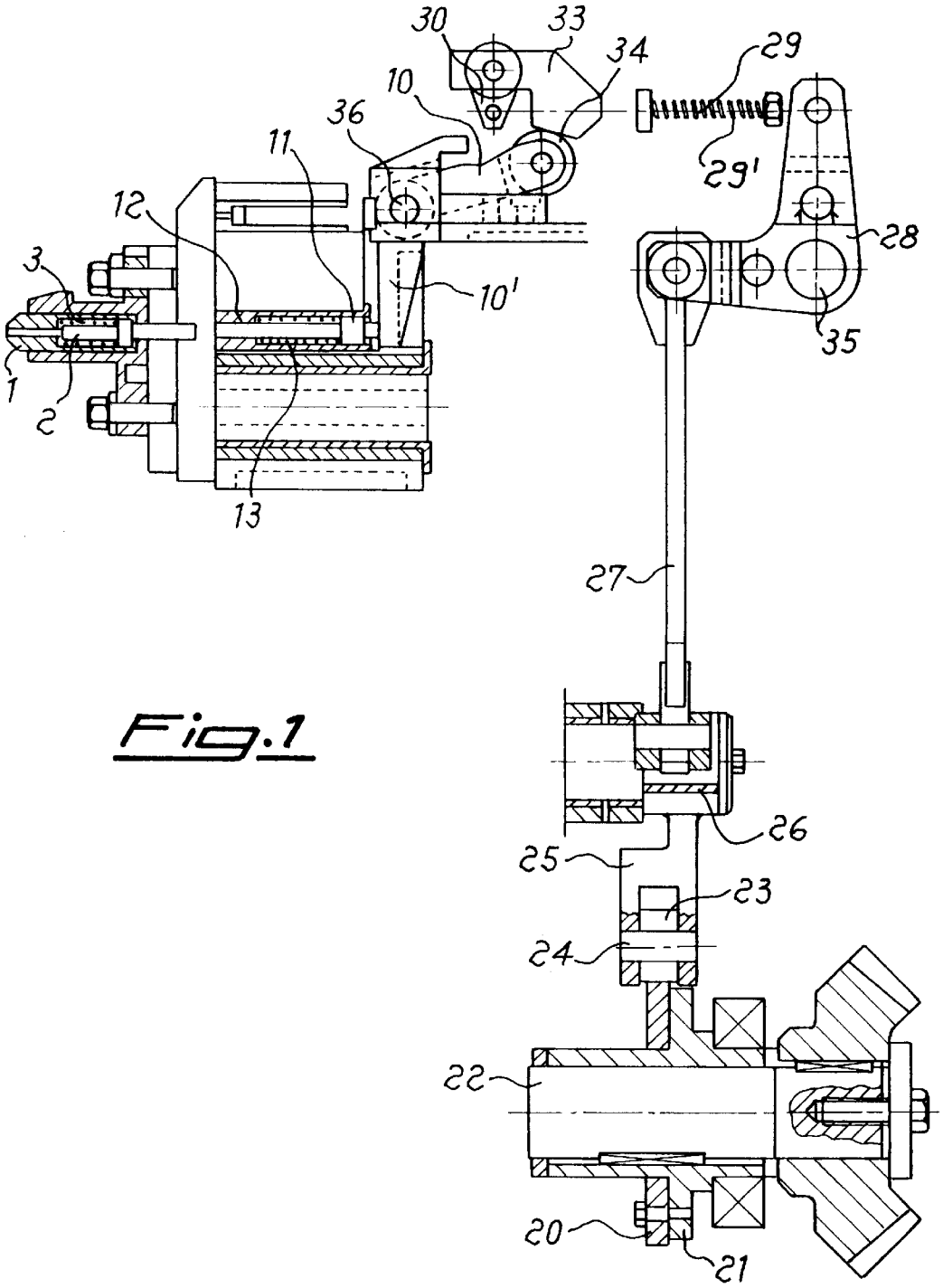

The present invention relates to a device for the extraction of small metal items from the relevant forging tools. In particular, the present invention relates to a device or positive extraction unit on first and second stroke from punches, especially utilisable in forging machines employed for the production of screws, rivets and the like.

The technological principle which the working of the machines is based on is the one of the cold forging of metal materials which, based on their mechanical properties, may be classified as ductile: the relatively small value of the ratio between the unit yield strength and the ultimate tensile stress, together with the high elongation upon break, characteristic of these materials, allow high permanent sets without breaking of the material. In this way, starting from semi-finished products, items are obtained that are very different from the original shape, with one only working step.

In particular, in the case of realisation of heads of screws, rivets, and the like, the above process uses a cylindrical semi-finished product obtained by straightening and cutting a circular skein of metal wire having a suitable section.

The so cut and straightened cylinder is inserted into a cylindrical restraining matrix having a length equal to that of the shank to be obtained. The part of the cylinder that protrudes from the matrix has a volume equal to the one of the head to be realised by permanent set. The permanent set which produces the head is therefore obtained by means of the action of a punch provided with a cavity wherein the shape of the head is obtained in negative; the possibility of realising the head according to the described method depends on the presence of an axial bucking element at the opposite end of the cylinder being worked.

The last working step, namely head attachment, consists in extracting from the tool the by now headed shank, whereby said tool is ready for working a subsequent item. In the machines of the known art, said step of extraction of the formed item has some severe drawbacks.

First of all, there must be alternatively used a special item holder depending on whether the extraction of pieces, which in some workings is not utilised, is included in the process.

As a consequence, in the last case the extraction device, if it is present in the preceding working step, must be removed, which involves direct operations to eliminate a part of the forging tool, with the ensuing delays in the production time.

Besides, in the known machines, the extraction device, which is conventionally located in correspondence of the front end of the tool, is activated according to a rigid system, which does not allow to anticipate or delay its movement, as would be suitable according to the different workings.

Object of this invention is to obviate the aforesaid drawback. More particularly, object of this invention is to provide a device for the extraction of small metal items especially applicable to forging machines employed for the production of screws, rivets and the like, and such as not to need to be unavoidaly removed from the tool when it is not utilised for some workings, as it does not interfere with the forging tools.

A further object of the invention is to realise an extraction device suitable to independently adjusted as concerns the advance or the delay of the movement.

A further object of the invention is to provide users with an extraction device as defined above, such as to ensure a high level of resistance and reliability in the time, and also such as to be easily and economically realised.

These and still other objects are achieved by the device for the extraction of small metal items of this invention, which comprises means articulated with one another and/or connected to the casing of the forging machine, activated by a drive shaft of the same through one or more cams or the like, and co-operating with the back end of one or more pegs coaxial with respect to the forged item placed in said punch(es).

Figure 2:
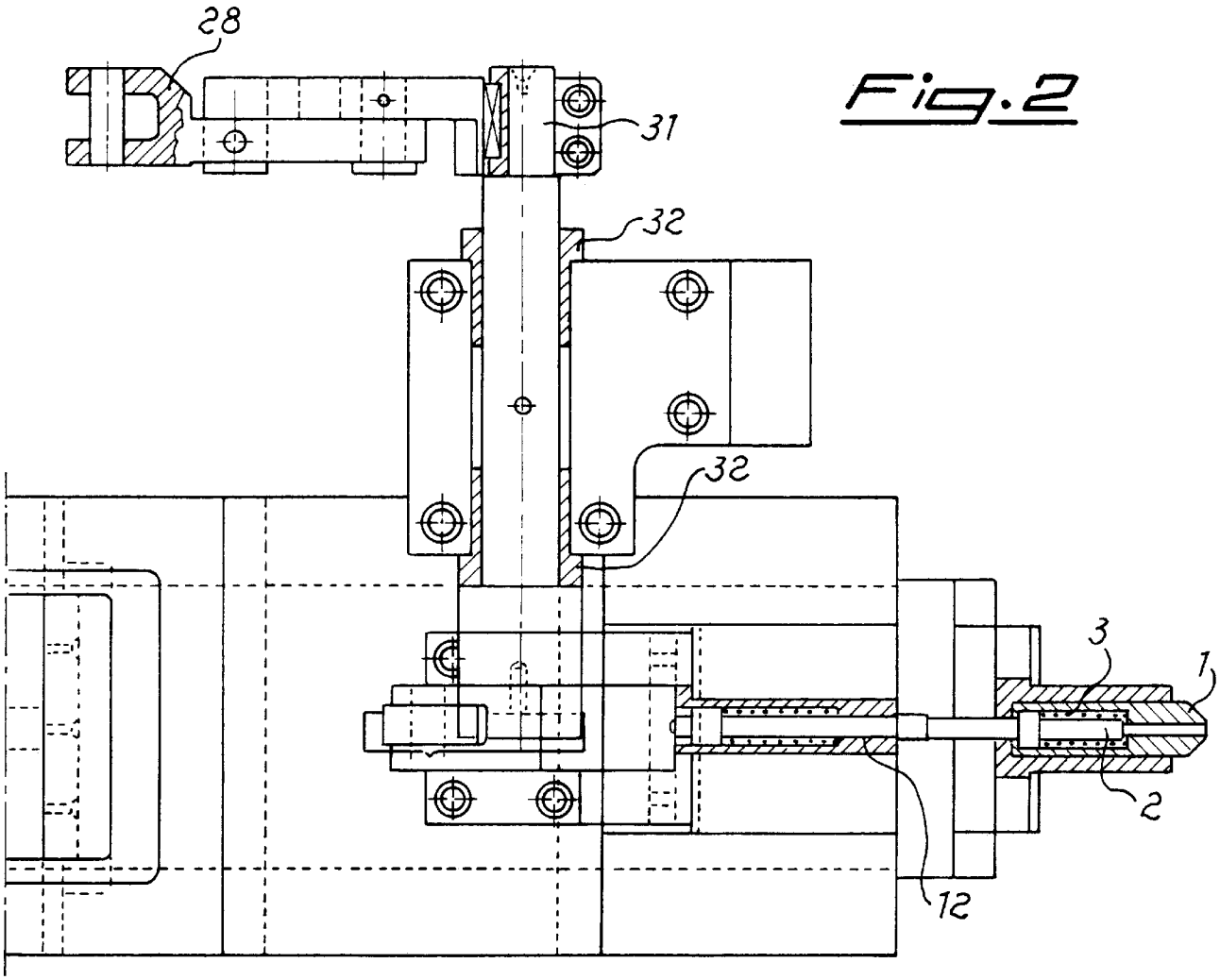

The construction and functional characteristics of the extraction device or unit of this invention, applicable in particular to automatic machines utilised for the production of screws, rivets and the like, will be better stressed by the following description, wherein reference is made to the attached drawings which represent a non limiting preferred embodiment of the same, and wherein:

FIG. 1 schematically shows a partly sectioned side view of the extraction device or unit of this invention;

FIG. 2 schematically shows a plan view of the same device.

With reference to the above figures, the extraction device or unit of this invention is connected to a shaft of the forging machine (not shown) preferably to the main drive shaft indicated by 22; the hub of a cam-holder 21 is keyed on said shaft, and a first cam 20 is fastened, by means of screws or the like, to the flange of said cam-holder. The connection is so realised that the angle position of cam 20 with respect to shaft 22 may be varied. A first lever 25 is hinged on a pin 26 integral with the casing of the forging machine; an end of lever 25 bears a roller 23 connected to the same through a pin 24. Cam 20 acts on roller 23, determining the oscillatory motion of lever 25 around the axis of pin 26.

A first rod or tie-rod is hinged at the opposite end of lever 25, by known means, pins or the like. In particular, rod 27 is hinged to an end of lever 25 and, at the opposite end, to a second lever 28; the latter is pivoted on the casing of the forging machine though a pin 35. Therefore, the control of the oscillation of lever 28 around pin 35 is obtained by means of rod 27.

At the opposite end of the second lever 28 a second rod or tie-rod 29 is connected, that is suitable to act on a third lever 30, keyed on a shaft 31 supported by the casing of the forging machine by means of bushings 32 or the like. Said lever 30 determines the oscillatory motion of shaft 31. At the opposite end with respect to the keying of lever 30, a second cam 33 is keyed, which acts, by means of a small roller 34, on a fourth lever 10, substantially triangle-shaped. Said lever 10 is pivoted on the casing of the forging machine by means of a pin 36, around which it oscillates, controlled by cam 33. A spring 29' is fitted on the second rod 29 and exercises the action of elastic return for the whole control mechanism, i.e., levers 25, 28, 30, rods 27, 29 and cam 33.

The vertical branch indicated by 10' of lever 10 co-operates with a first peg 11, located in a seat 12 behind the forming punch, indicated by 1; a spring 13 is fitted on peg 11, which slides with an alternating rectilinear motion in seat 12, pushed forwards by the vertical branch 10' of lever 10 and is returned by said spring. To the casing of the forging machine there is fastened by a flange the forging equipment constituted by punch 1, of a known type, wherein a second peg 2 is located that is aligned with peg 11 and is also provided with a fitted on spring, indicated by 3. Said peg 2 moves axially in its own seat, pushed forwards by peg 11 located behind it and coaxial with respect to the same, and elastically returned by spring 3.

The working of the extraction device of this invention is articulated as follows.

The forging of the head of the small metal items starting from wire is realised with the shank retained in punch 1 and bucked in the axial direction by peg 2. In this stage, peg 2 rests on a conventional ledge collar. The extraction of the shank after the forging of the head is caused by the same peg 2 pushed in the axial direction, in a direction opposite to the edge collar, by the activation device. Spring 3 brings then the peg in strike position on the collar.

The whole of punch 1, peg 2 and spring 3 constitutes an independent tool, connected to the remaining part of the extraction unit by means of a flanged connection with lag screws. Expulsion activation is ensured by lever 10 which pushes, with its first vertical branch 10', peg 11, driven in element 12, in an axial direction against peg 2. The return of peg 11 is ensured by the coaxial spring 13.

The oscillatory movement of lever 10 is caused by the described kinematic chain of cams and levers which is driven by the main drive shaft 22 of the automatic machine. The kinematic chain of cams and levers starts from cam 2, flanged with screws to cam-holder 21, keyed on the main drive shaft 22. Cam 20 activates lever 25 by means of roller 23 mounted on lever 25 with pin 24. In this way, lever 25 oscillates around the axis of pin 26 and, in its turn, controls the first rod or tie-rod 27 by means of the end opposite to the one that bears roller 23. Tie-rod 27 controls therefore lever 28 which, by oscillating around axis 35, transmits an alternating motion to tie-rod 29 which, in its turn, determines the oscillatory motion of lever 30.

The oscillatory motion of lever 30 is transmitted to shaft 31. Shaft 31, and the end opposite to that of lever 30 bears cam 33 which, through roller 34, determines lastly the movement of lever 10, which activates peg 11.

Spring 29', coaxial with respect to tie-rod 29, ensures the return motion of the kinematic chain of cams and levers which, driven by the main drive shaft, activates lever 10.

The possibility of modifying the angle position of cam 20 on cam-holder 21, or to replace it, allows the adjustment of the extraction movement independently on the mounted equipment. As can be understood from the above, the advantages of the invention are obvious.

The device for the extraction of small metal items of the present invention, applicable in particular to forging machines for the production of screws, rivets and the like, does not involve the removal of part of the equipment even if the extraction of the items is not included in the process; the extraction unit is in fact located behind the forming tool and never ever interferes with the same.

Particularly advantageous is the possibility of advancing or delaying the movement of the device thanks to the presence of the cam connected to the main drive shaft of the forging machine.

The invention, as described hereabove and claimed hereafter, has been proposed by way of non limiting and non critical example, the same being susceptible of changes and variants, which fall anyhow within the scope of the novel concept.

What is claimed is:

1. A device for the extraction of small metal items, applicable to an automatic forging machine employed for the production of such small metal items, said forging machine having a casing and at least one forming punch (1), said device comprising:

a) a first lever (25) pivotally mounted through a first pin (26) to the casing of the forging machine, said first lever having a first end on which a roller (23) is mounted;

b) a tie rod (27) having a first end hingedly connected to a second end of said first lever (25);

c) a second lever (28) having a first end hingedly connected to a second end of said tie rod (27) and pivotally mounted through a second pin (35) to the casing of the forging machine;

d) an operating rod (29) cooperating with a second end of said second lever (28) and having a coaxial return spring (29) thereon;

e) a third lever (30) having a first end cooperating with said operating rod (29) and keyed to a shaft (31) supported on the casing of the forging machine;

f) at least one cam (20) keyed on a drive shaft (22) and operating on said roller (23) to cause said first lever (25) to oscillate about said first pin (26); and g) at least one peg (11,2) coaxially disposed in said forming punch (1) operatively cooperating with said third lever (30) to be caused to be moved thereby.

2. The device according to claim 1 which further includes a second cam (33) carried on said shaft (31), a roller (34) following on said second cam (33) and carried on a fourth lever (10), said fourth lever (10) operatively cooperating with said at least one peg (11,2).

3. The device according to claim 1, wherein said cam (20) is fastened to a cam-holder (21) keyed on the main drive shaft (22) of the forging machine.

4. The device according to claim 2, wherein said second cam (33) is keyed on said shaft (31) at an opposite end with respect to said third lever (30).

5. The device according to claim 2, wherein said lever (10) is made by two integral branches orthogonal to one another, one of which (10'), oriented in a substantially parallel direction with respect to said tie-rod (27), co-operates with said peg (11), housed in a seat (12) behind the forming punch(es) (1).

6. The device according to claim 2, wherein said lever (10) is connected to the casing of the forging machine through a pin (36) around which it oscillates by effect of said second cam (33).

7. The device according to claim 5, wherein said peg (11) slides according to a rectilinear alternating motion in said seat (12), under the action of said branch (10') of said lever (10) and is provided with elastic return means (13).

8. The device according to claim 7, wherein said peg (11) interacts with the second peg (2) housed in the forming punch(es) and is provided with elastic return means (3).

* * * * *